US007755899B2

(12) United States Patent
Stenmark

(10) Patent No.: US 7,755,899 B2
(45) Date of Patent: Jul. 13, 2010

(54) MINIATURIZED HIGH CONDUCTIVITY THERMAL/ELECTRICAL SWITCH

(75) Inventor: Lars Stenmark, Trosa (SE)

(73) Assignee: ÅAC Microtec AB, Uppsala (SE)

( * ) Notice: Subject to any disclaimer, the term of this patent is extended or adjusted under 35 U.S.C. 154(b) by 111 days.

(21) Appl. No.: 12/087,724

(22) PCT Filed: Jan. 18, 2007

(86) PCT No.: PCT/SE2007/050030

§ 371 (c)(1),
(2), (4) Date: Jul. 9, 2008

(87) PCT Pub. No.: WO2007/084070

PCT Pub. Date: Jul. 26, 2007

(65) Prior Publication Data

US 2009/0040007 A1 Feb. 12, 2009

(30) Foreign Application Priority Data

Jan. 18, 2006 (SE) ..... 0600096

(51) Int. Cl.
*H01H 37/48* (2006.01)
*F28F 27/00* (2006.01)
*F25D 29/00* (2006.01)

(52) U.S. Cl. ..... 361/710; 361/709; 337/324; 337/393; 165/276; 62/383

(58) Field of Classification Search ..... 337/298, 337/324, 392–394, 299; 361/709, 710; 165/276; 62/383

See application file for complete search history.

(56) References Cited

U.S. PATENT DOCUMENTS 3,306,075 A * 2/1967 Cowans ..... 62/51.1
3,531,752 A * 9/1970 Gourley ..... 337/139
4,770,004 A * 9/1988 Lagodmos ..... 62/383
5,325,880 A 7/1994 Johnson et al.
5,379,601 A * 1/1995 Gillett ..... 62/51.1
5,682,751 A * 11/1997 Langhorn et al. ..... 62/51.1

(Continued)

FOREIGN PATENT DOCUMENTS

EP 1 001 440 A2 5/2000

OTHER PUBLICATIONS

Lena Klintberg, Mikael Karisson, Lars Stenmark, Jan-Åke Schweitz and Greger Thornell, "A large stroke, high force paraffin phase transitiion actuator," Sensors and Acuators, A, 2002, vol. 96, No. 2-3, pp. 189-195.

*Primary Examiner*—Anatoly Vortman
(74) *Attorney, Agent, or Firm*—Lucas & Mercanti, LLP

(57) ABSTRACT

The present invention is a thermally controlled switch with high thermal or electrical conductivity. Microsystems Technology manufacturing methods are fundamental for the switch that comprises a sealed cavity formed within a stack of bonded wafers, wherein the upper wafer comprises a membrane assembly adapted to be arranged with a gap to a receiving structure. A thermal actuator material, which preferably is a phase change material, e.g. paraffin, adapted to change volume with temperature, fills a portion of the cavity. A conductor material, providing a high conductivity transfer structure between the lower wafer and the rigid part of the membrane assembly, fills another portion of the cavity. Upon a temperature change, the membrane assembly is displaced and bridges the gap, providing a high conductivity contact from the lower wafer to the receiving structure.

21 Claims, 10 Drawing Sheets

U.S. PATENT DOCUMENTS 5,842,348 A * 12/1998 Kaneko et al. ..... 62/51.1
6,276,144 B1 * 8/2001 Marland et al. ..... 62/51.1
6,305,174 B1 * 10/2001 Binneberg et al. ..... 62/6
6,332,318 B1 12/2001 Thorn
6,438,967 B1 * 8/2002 Sarwinski et al. ..... 62/6
6,829,145 B1 * 12/2004 Corrado et al. ..... 361/704
7,154,369 B2 * 12/2006 Dietz et al. ..... 337/394
7,411,792 B2 * 8/2008 Richards et al. ..... 361/704

* cited by examiner

MINIATURIZED HIGH CONDUCTIVITY THERMAL/ELECTRICAL SWITCH

This application is a U.S. National Phase Application under 35 USC 371 of International Application PCT/SE2007/050030 filed Jan. 18, 2007, which claims the benefit of Swedish Patent Application No. 0600096-2 filed Jan. 18, 2006.

TECHNICAL FIELD OF THE INVENTION

The present invention relates to a structure for thermal or electrical control, particularly for thermal control in space applications.

BACKGROUND OF THE INVENTION

In many devices, wherein a substantial amount of heat is generated, there is a need for an active thermal control, in order to maintain the desired operational temperature for the device. A common solution is to use the air in the atmosphere for transport of the excessive heat by use of electromechanical fans or ventilators. This is an effective but sometimes noisy solution, wherefore conduction of the heat through passive or active heat conductors to a thermal radiator in many times is a preferred solution. In particular, in space applications, operating in vacuum, this is the only solution if direct radiation of the heat into space is impossible.

For example, in the development of small but very efficient spacecraft with high internal power density thermal control becomes a growing area of concern. The low thermal mass of a small spacecraft makes it necessary to radiate excessive heat when active, but on the other hand the internal part of the spacecraft must be thermally isolated from external radiator surfaces when passive in order to keep the internal temperature at an acceptable level. If the active and passive modes are synchronized with entering or leaving eclipse (earth shadow) the problem becomes even worse. To solve the problem an active thermal control system with a heat flux modulation capability must be used.

Such a heat flux modulation can be based on a number of design principles. A liquid can be pumped around in the system carrying the heat from the source to the radiator. Passive heat pipes (extremely good thermal conductors) or active heat pipes, in which a liquid in vapor phase is used in a tube to transport the heat. The heat transport capability in such a heat-pipe is normally directly related to the temperature on the hot side. In some variable active heat pipers, the heat transport capability can be controlled by controlling the boil rate of the liquid. Another alternative is mechanical systems, where mechanical switches are used together with very good thermal conductors, i.e. passive heat pipes. The mechanical switch creates a gap with very low thermal conductivity in the off-mode.

The heat flux modulation is a key parameter for all thermal control systems. Particular on the small spacecraft with a modern distributed functionality the mechanical system is most likely to prefer due to the simplicity, given that the heat switches have high modulation capability, are compact and have low mass.

A switch designed for high thermal conductivity may naturally be particularly useful as an electrical conductor as well. When optimized for high electrical conductivity such a switch may be used as a high current electrical switch.

However, in general, mechanical switches according to prior art have rather low heat flux modulation capability or current switching capability, especially in relation to their physical size. In particular, since the trend is that other components of spacecraft or other systems are miniaturized using for example Microsystems Technology (MST) or Microelectromechanical Systems (MEMS), conventional mechanical switches become too large and inefficient, or cannot readily be implemented in such a miniaturized system.

SUMMARY OF THE INVENTION

Obviously the prior art has drawbacks with regards to being able to provide thermally controlled high conductivity switches with high switching capability compared to the physical size of the switch.

The object of the present invention is to overcome the drawbacks of the prior art. This is achieved by the device as defined in claim 1.

The high conductivity switch according to the invention comprises a sealed cavity with a first wall and a second wall, wherein at least the second wall is a membrane assembly. The second wall is adapted to be arranged with a gap to a receiving structure. A thermal actuator material that is adapted to change volume with temperature fills a portion of the cavity. A conductor material fills another portion of the cavity. The conductor material provides a high conductivity transfer structure between the first wall and the second wall. The thermal actuator material is arranged to upon a temperature induced volume change, displace the second wall, so that the gap to the receiving structure can be bridged, providing a high conductivity contact from the first wall to the receiving structure.

The cavity may be formed within bonded wafers, preferably silicon wafers, but metal sheets, ceramic, polymer or glass are examples of other wafer materials.

The temperature induced volume change may at least partly be caused by a phase change of the actuator material, typically from liquid to solid state, occurring at a predefined temperature or temperature interval. Paraffin is a preferred actuator material with such properties.

To provide a flexible heat transfer structure the conductor material may be in liquid phase at least at the phase change temperature of the actuator material. Metal or metal alloys may be used and are kept in a central position within the cavity by using coatings with particular wetting properties and/or enclosure posts protruding from at least on wafer.

The conducting properties of the high conductivity switch can be optimized for thermal or electrical control by choosing a conductor material with high electrical or thermal conductivity. A switch according to the present invention with high electrical conductivity may be provided with electrical feedthrough integrated in the wafers.

Thanks to the invention it is possible to provide miniaturized mechanical switches with improved on/off modulation with respect to high thermal and electrical conductivity.

One advantage of the switch according to the invention is that the switch can be arranged to be automatically and reversibly activated by the heat generated by the heat source.

Embodiments of the invention are defined in the dependent claims. Other objects, advantages and novel features of the invention will become apparent from the following detailed description of the invention when considered in conjunction with the accompanying drawings and claims.

BRIEF DESCRIPTION OF THE DRAWINGS

Preferred embodiments of the invention will now be described with reference to the accompanying drawings, wherein.

DETAILED DESCRIPTION OF EMBODIMENTS

A high conductivity switch according to the present invention opens new possibilities for thermal and electrical control and for the implementation of different miniaturized systems, particularly in space applications.

Figure 1:
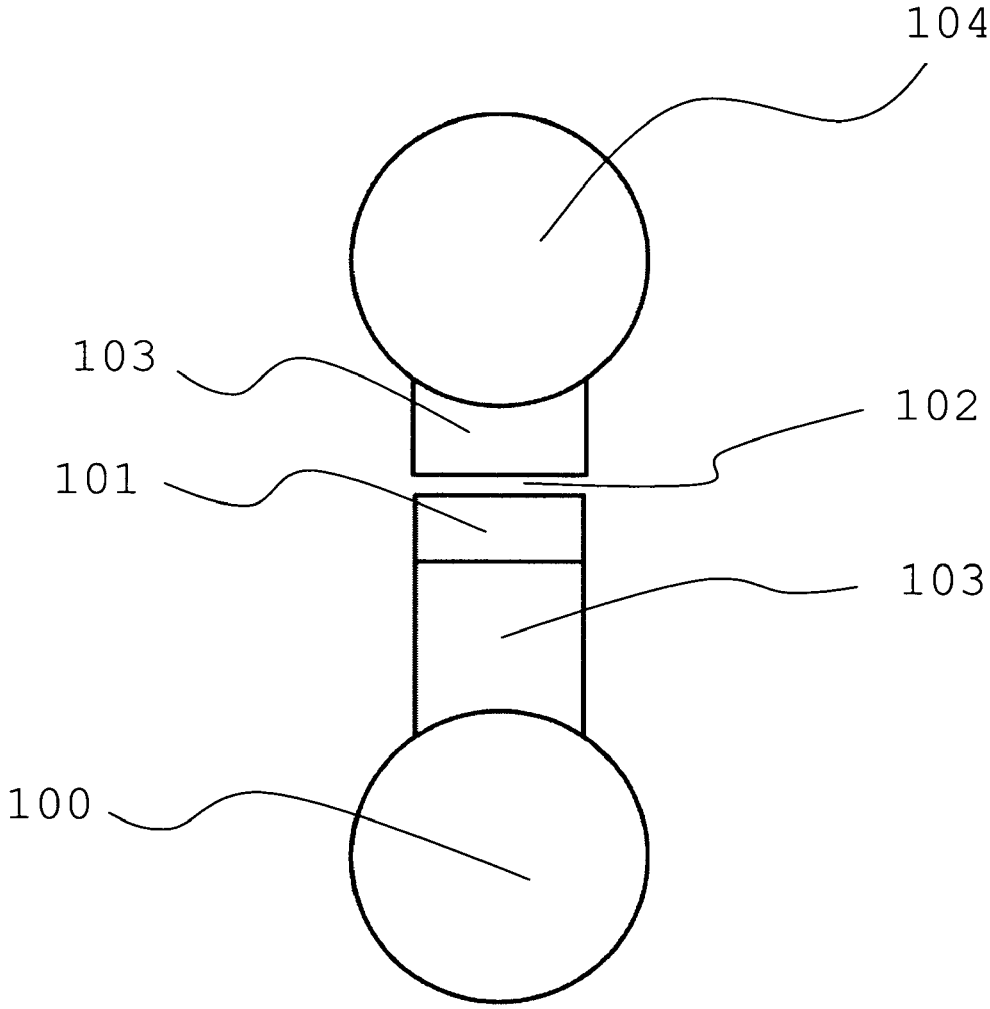
FIG. 1 is a schematic illustration of a general mechanical thermal control system.

An active thermal control system is schematically illustrated in FIG. 1. If an excessive amount of heat is generated in an arbitrary device 100, i.e. the heat source, it might be necessary to conduct some heat away from the device 100 in order to avoid overheating. This is accomplished through one or two heat conductors 103 to a thermal heat sink 104, which can be a radiator or a latent heat storage device. The two heat conductors 103 are separated by an air gap 102 in sequence with a thermal switch 101. At a certain predetermined temperature the switch 101 closes the air gap 102 permitting a high heat flux to flow from the heat source 100 to the heat sink 104. A desired feature of the thermal switch 101 is to have as high temperature modulation as possible, i.e. the ratio between heat conductivity in off state and on state shall be as high as possible.

The high conductivity switch according to the present invention, which is based on MEMS/MST, is primary intended for applications where small size and mass are desirable features and provides unsurpassed high thermal conductivity in the on state. The total thickness of the switch 101 can be less than 1 mm with a cross-section area matching the size of the heat conductors 103, i.e. a few $mm^2$ up to several $cm^2$.

Figure 2:
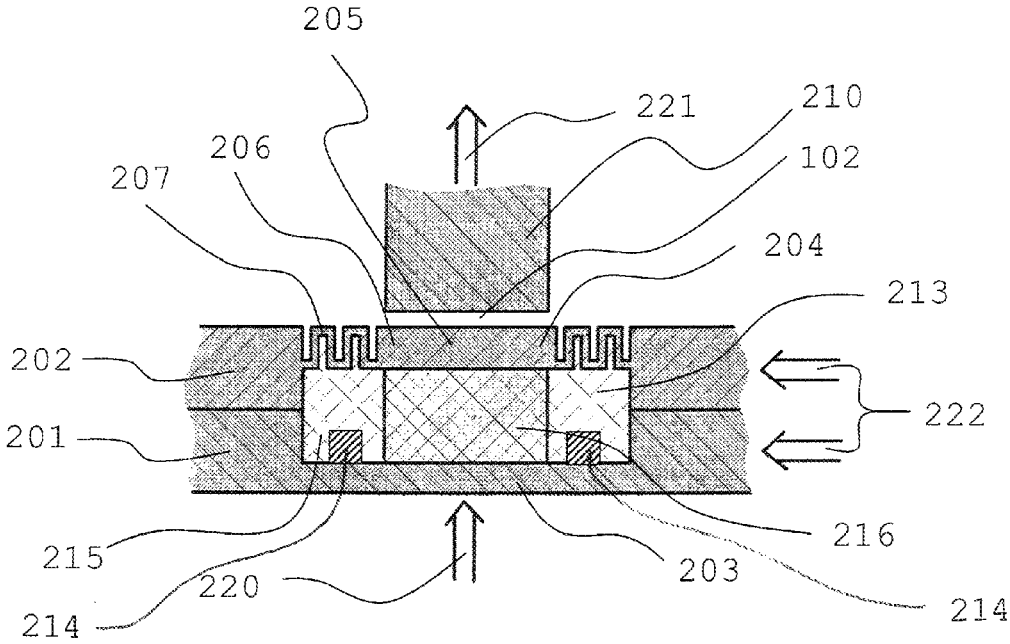
FIG. 2 is a cross-sectional view of a switch according to the present invention.

One embodiment of the present invention comprises at least two horizontal wafers 201, 202 bonded together, as illustrated in FIG. 2. A sealed cavity 213 is formed between the two wafers 201,202, wherein the lower wafer 201 provides a lower first wall 203 and the upper wafer 202 provides an upper second wall 204 of the cavity 213. The cavity 213 is filled with both a thermal actuator material 215 and a heat transfer structure 216 comprising a conductor material making a central connection between the lower wall 203 and the upper wall 204 that is formed as a membrane assembly 205 comprising a thin (and corrugated) membrane 207 and a rigid central part 206 above the cavity 213. The purpose of the heat transfer structure 216 is to ensure a very good thermal contact between the central part 206 of the membrane 205 in wafer 202 and the wall 204 of wafer 201 where the main part of the input heat flux 220 is entering the system. There is also a lateral heat flux 222, but as the thin (and corrugated) membrane 207 is a poor heat conductor, the most of the heat flux will go down into wafer 201 and further into the heat transfer structure 216. The heat transfer structure 216 must be flexible as the distance between the central membrane 206 and the lower wall 203 changes when the actuator material 215 is activated. Preferably an actuator material 215 that goes through a phase change, e.g. a transition from solid to liquid state, at a given temperature or at a temperature interval is utilized. As more and more of the actuator material 215 goes through the phase change, the central part 206 of the flexible membrane 205 will move upwards until the gap 209 is closed and a good thermal contact with the heat conductor in the receiving structure 210 or pickup structure is established, permitting the heat flux 220 to flow towards the heat sink 104. When the temperature is going down, the actuator material 215 solidifies with decreasing volume as a consequence and the thermal contact to the heat sink 104 is broken.

The wafer 201,202 material will most likely be silicon as silicon is the most common material in the MST/MEMS field. However it can also be e.g. metal sheets, micromachinable glass, polymer or a ceramic material. For the application as an electrical switch, in which good electrical isolation is a major concern, the insulator materials are of particular interest. The electrical switch embodiment is presented later in this description. Suitable methods for shaping the wafers are, but is not limited to, etching, injection molding, electro discharge machining (EDM), rolling, laser ablation, punching etc. The wafers are bonded together. Bonded should here be interpreted in a general way meaning joining the wafers in a manner that is suitable for the materials used. Bonding include, but is not limited to fusion bonding, anodic bonding, using adhesives, welding, soldering, clamping.

As mentioned, the thermal actuator material 215 may be a phase change material, due the attractive properties of such materials. In particular paraffin or paraffin-like material can be used if the switch shall be activated at a certain over temperature. Paraffin materials expand with as much as 10 to 20% in the transition from solid to liquid and the melting point temperature can be chosen from minus several tens of C.° to plus several hundreds C.°. Melting occurs over a very limited or a broader temperature interval depending on the composition of the paraffin and the lengths of the hydrocarbon chains in the paraffin. On the other hand, if the switch shall be activated when temperature is going down, a material with opposite properties can be used. Water is a good example as it expands around 10% in the transition from liquid to solid (water to ice). The main drawback with paraffin as an actuator material and a thin flexible membrane is the rather poor heat conductivity through the paraffin and also, although not necessarily, through the thin membrane. By the inclusion of a thermal bridge, i.e. the heat transfer structure, of liquid conductor material the conductivity is dramatically improved. This results in a much higher heat conductivity modulation. An alternative to the phase change materials is to use the thermal expansion of materials within the same phase, wherein the switch is designed so that the expansion of the thermal actuator material makes the flexible membrane bridge the gap at a certain temperature.

The conductor material in the heat transfer structure 216 may be a low melting point metal or metal alloy. The melting point temperature for the metal or metal alloy is lower than the phase change temperature for the actuator material 215. Either the conductor material in the heat transfer structure 216 is solid in the off-state and then melts in the on state or the conductor material 216 is liquid all the time.

Figure 3:
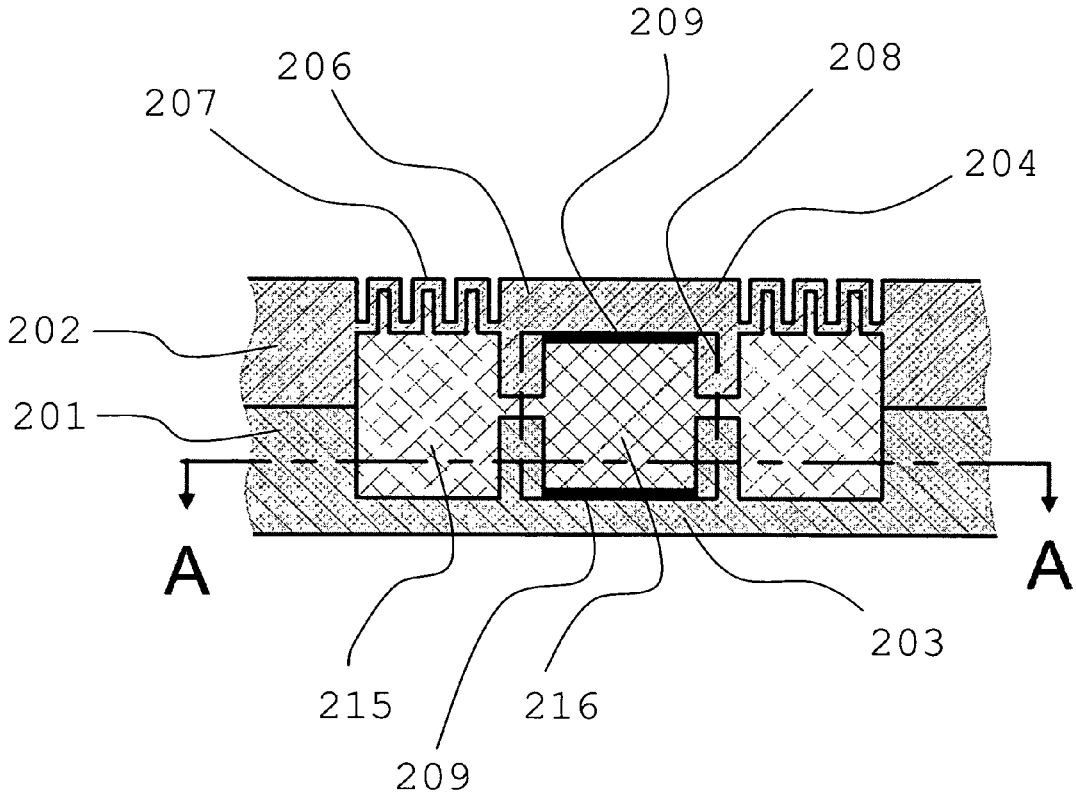
FIG. 3 is a cross-sectional view of a switch according to the invention that comprises enclosure posts.
Figure 4:
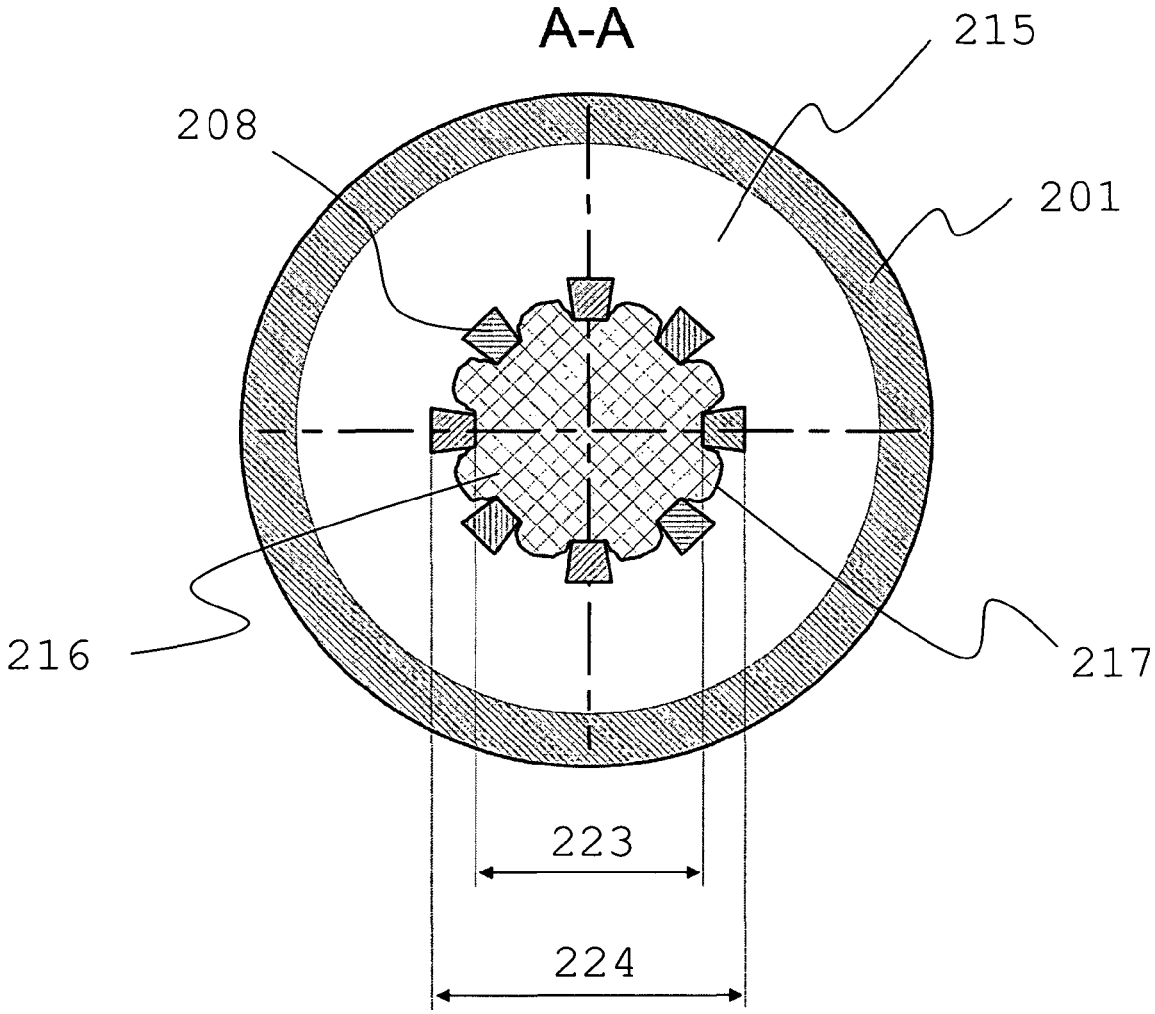
FIG. 4 is a top view of the switch in FIG. 3 illustrating the enclosure of the heat transfer structure in the switch.

Another embodiment of the present invention is shown in FIG. 3. Two micromachined silicon wafers 201,202 are bonded together forming a sealed cavity 213 with a flexible membrane 205, which comprises a rigid central part 206 and a concentric thin and corrugated part 207, in the upper wafer 202. A number of enclosure posts 208 protruding from the central part 206 of the flexible membrane 205 form a more or less open cage surrounding the low melting point metal or metal alloy 216. The liquid metal 216 is kept in place due to two factors. First, the wafer 201, 202 surfaces inside the posts 208 are coated with a coating 209, e.g. a metal or metal alloy, with good wetting properties against the liquid metal 216. Second, as the liquid metal 216 does not mix with the actuator material 215 or wets against the non-coated wafer material it will not pass the surrounding posts 208. A picture of a cross-section A-A through wafer 201 is given in FIG. 4 showing eight posts 208 arranged to keep the liquid metal 216 inside the posts 208 that are enclosed by the actuator material 215 within the cylindrical cavity 213. The interface between the actuator material 215 and the liquid metal 216 is located in between the posts 208, and when the actuator material 215 expands, increasing the pressure in the cavity 213, the interface border 217 is pushed towards the centre. The number of post 208 as well as the internal diameter 223 and the external diameter 224 can be optimized for each design case. For small switches, it is possible that the posts 208 can be totally omitted.

The switch according to the invention is arranged to be automatically and reversibly activated by the heat generated by the device 100. In one embodiment an electrical heater 214 inside or in thermal contact with the actuator material 215 can be used to heat and activate the actuator material 215 if electrical control of the switch function is preferred before the thermal actuation.

In another embodiment of the present invention the single central heat transfer structure 216 is replaced by distributed heat transfer structures, i.e. several columns of heat transfer structure material with smaller diameter, each surrounded by actuator material 215. Consequently the cross-section area becomes smaller, but the heat distribution to the actuator material 215 is different, since a larger portion of the actuator material 215 is in close contact to the heat transfer material 216.

In one embodiment of the present invention comprising two bonded micromachined silicon wafers 201,202, the heat transfer structure 216 does not have complete contact with the membrane 205. A thin layer of the enclosing actuator material 215 is present between the membrane 205 and the heat transfer structure 216. Enclosure posts 208 protruding from the lower wafer 201 and a coating 209 on the wafer 201 in an area defined by the posts 208 keeps the conductor material 216 in place.

Figure 5A:
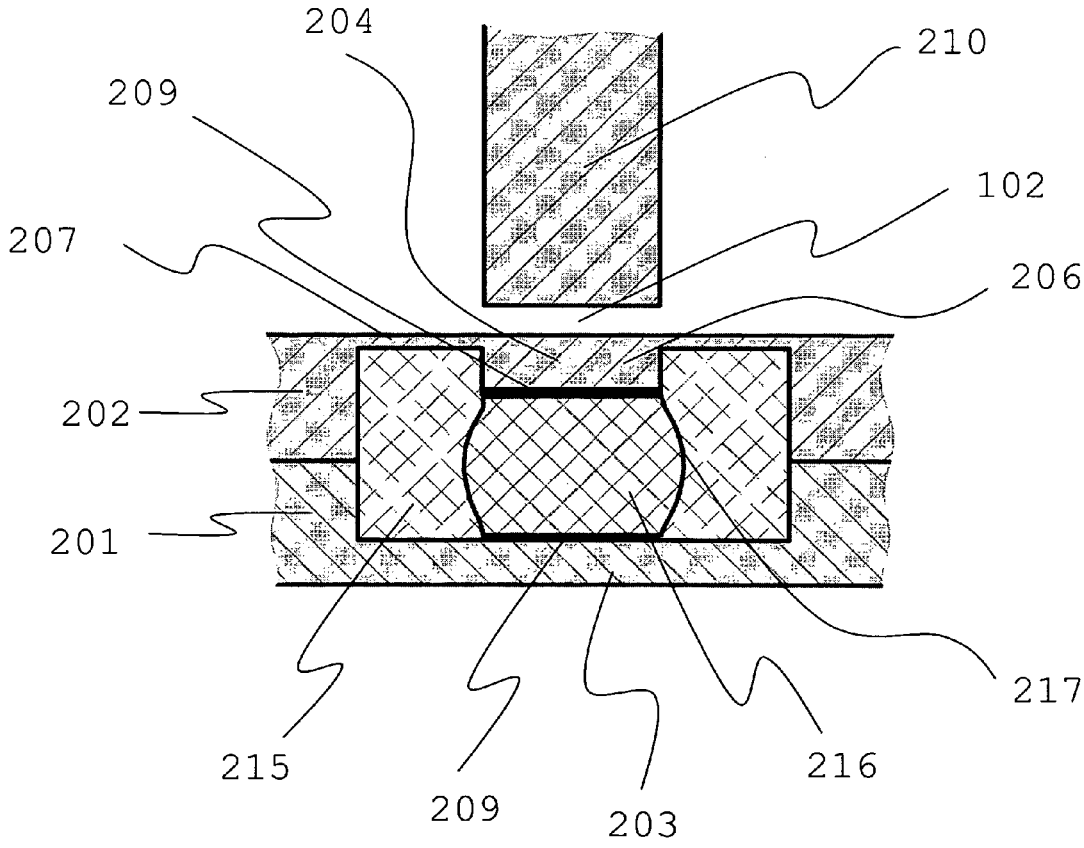
FIG. 5*a* is a cross-sectional view of a switch in the low temperature off mode.
Figure 5B:
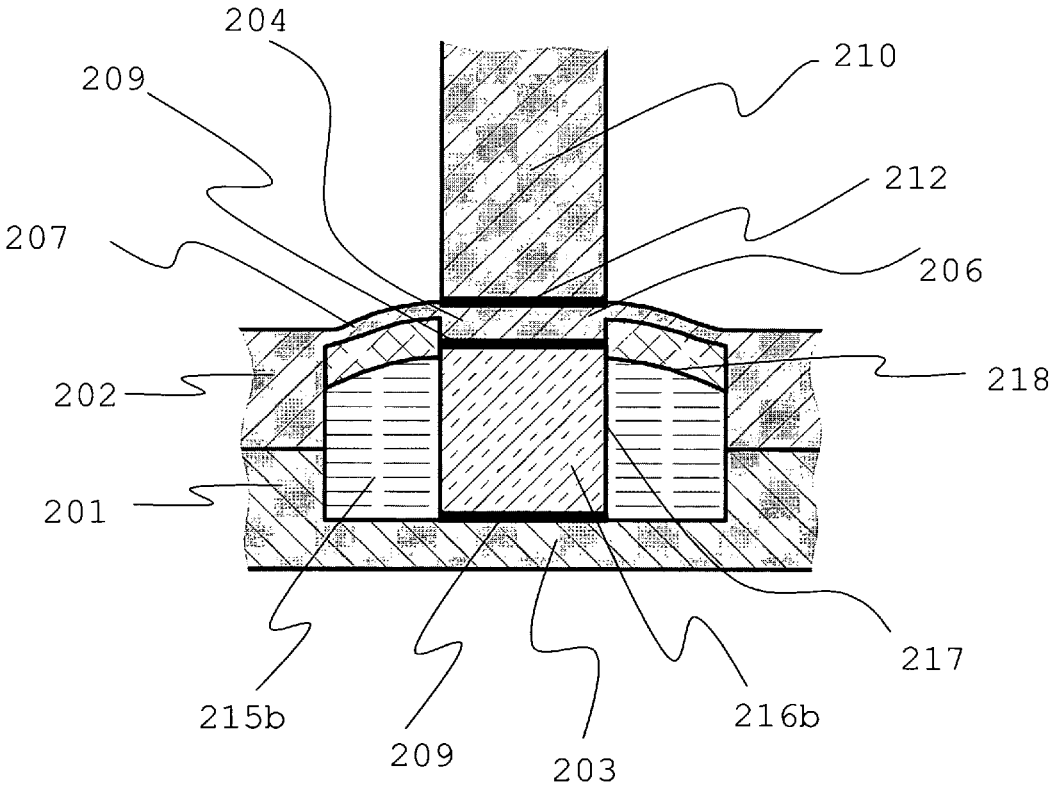
FIG. 5*b* is a cross-sectional view of a switch at the moment of thermal contact.
Figure 5C:
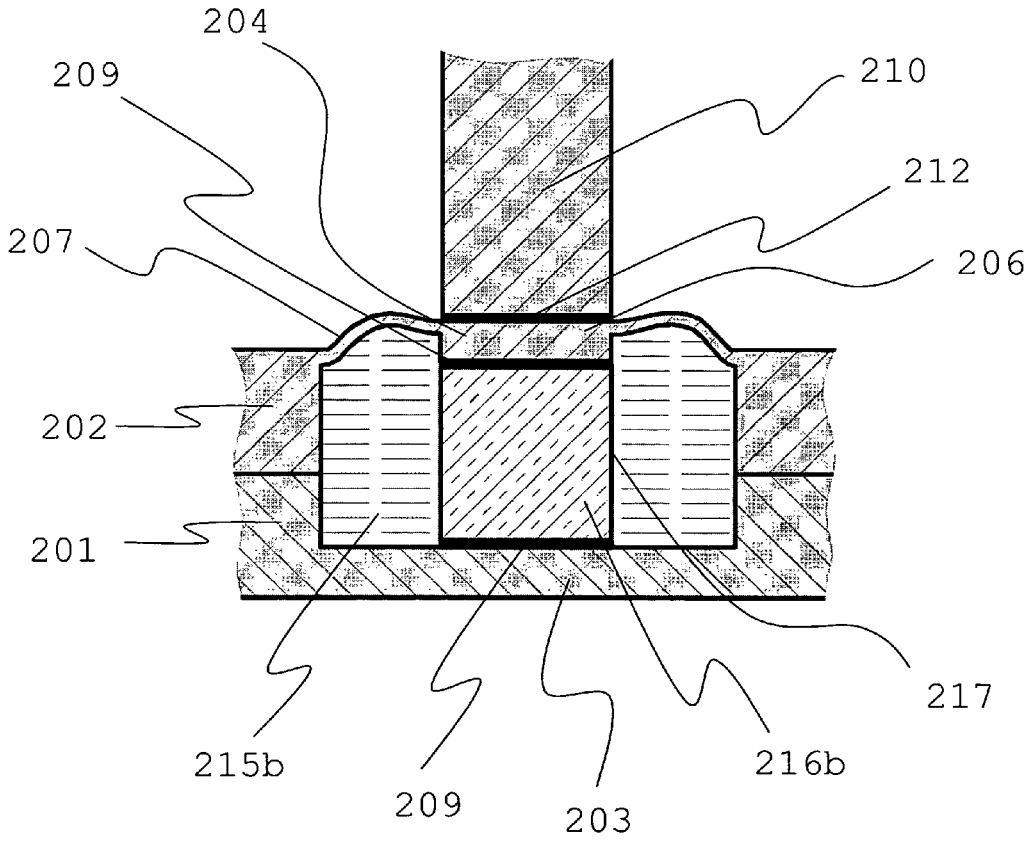
FIG. 5*c* is a cross-sectional view of a switch in the over temperature mode.

FIGS. 5*a*, 5*b* and 5*c* illustrate the conditions inside the switch for three operational modes: low temperature mode in FIG. 5*a*, thermal contact moment in FIG. 5*b* and over temperature mode in FIG. 5*c*. At low temperature, the membrane 205 is approximately flat, see FIG. 5*a*, and the gap 102 between the receiving structure 210 and the membrane central part 206 is at its maximum. The heat transfer structure 216 is solid, bulging with a slight convex contour of the interface surface 217. The actuator material 215 is also in the solid phase.

When a heat flux is flowing into the device into the first wall 203, the following will occur, see FIG. 5*b*. First, when the temperature is increased, at a certain temperature or within a limited temperature interval, the heat transfer material 216*b* melts. Second, at a higher temperature, the actuator material 215 phase change starts whereby the heat transfer structure 216*b* is squeezed together, the membrane 205 is lifted, and gap 102 is decreased. In the moment of thermal contact the insulating gap 102 is closed and a thermal contact 212 is formed between the rigid part 206 of the membrane and a receiving structure 210. At this moment the solidification front 218 in the solid actuator material 215 and the liquid actuator material 215*b* has almost reached the membrane 205 and only a portion of the solid actuator material 215 remains. The membrane 205 is slightly deflected.

When the temperature continues to increase, the switch is going into over-temperature mode, see FIG. 5*c*. Finally all actuator material 215*b* has melted. The liquid heat transfer structure 216*b* still has approximately the same shape as in FIG. 5*b*, as the receiving structure 210 above the thermal contact prevents the central part 206 of the membrane 205 to move further upwards. The additional volume caused by the phase change of the remaining part of the actuator material 215 in FIG. 5*b* generates an increased deflection of the thin part of membrane 207.

The design of the switch according to the present invention is made to facilitate a reversible and stable operation of the switch. This is simplified by using a symmetrical structure where the heat flow is more or less symmetrical laterally, and by the fact that the membrane provides a spring force acting to return the membrane to the original position. The latter, in combination with a reduced pressure in the cavity upon solidification of the phase change material and surface forces in the interface between actuator material and conductor material, with a proper design, preserve the conditions described in FIG. 5*a-c*.

In one embodiment the switch can be designed to be normally closed, i.e. with the second wall 204 in contact with the receiving structure 210 in analogy with the low temperature mode described above. When the actuator material 215 expand upon a temperature change, e.g. paraffin changes phase due to a temperature increase, the second wall 204 looses contact with the receiving structure 210 and the high conductivity contact is broken and width of the gap 102 with low conductivity increases.

Figure 6:
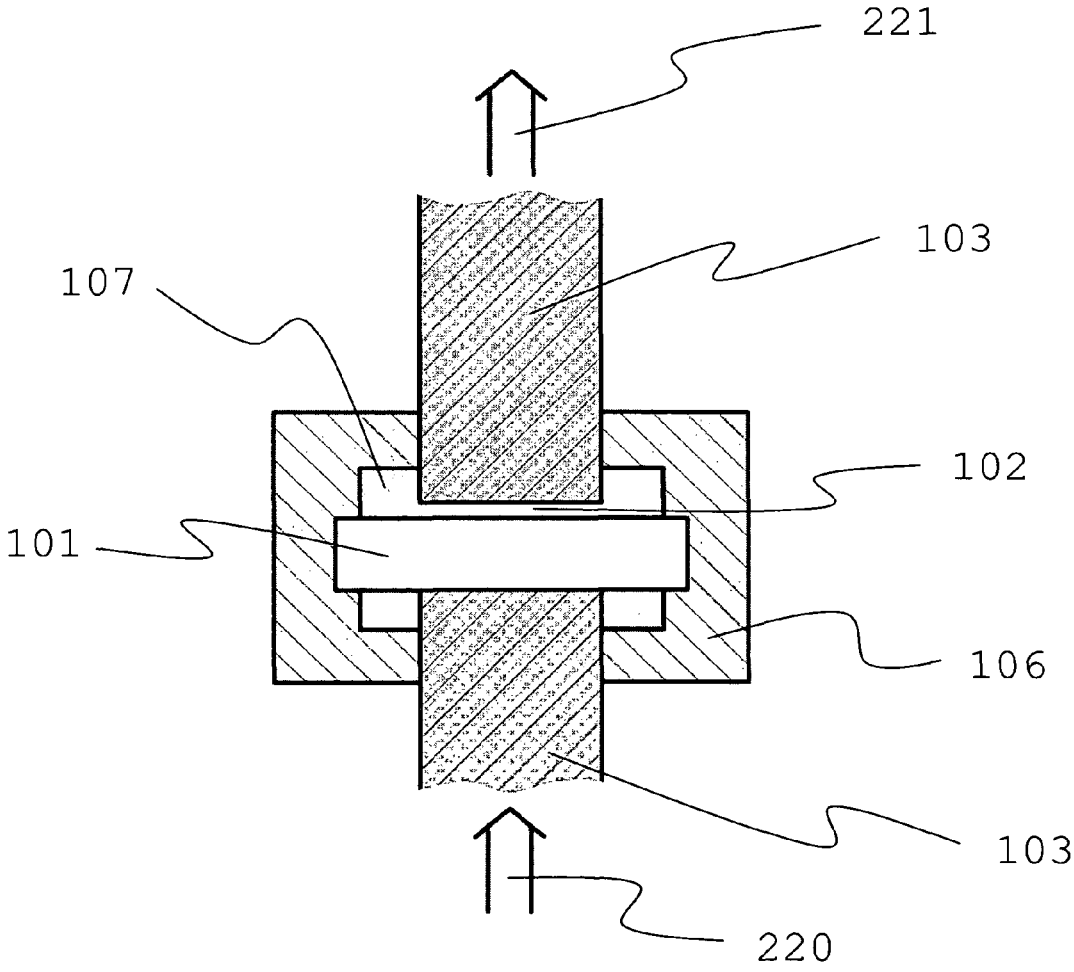
FIG. 6 is cross-sectional view of an implementation of the present invention in a freestanding, normally off, thermal switch between two heat conductors.

The switch device 101 can be an integrated part of a larger microsystem or be used as a freestanding device as in another embodiment of the present invention, which is illustrated in FIG. 6. The switch 101 is embedded in a support structure 106. The heat conductors 103 are also fixed in the support structure 106. A small gap 102 is left between one of the heat conductors 103 and the membrane 205 of the heat switch 101. When the switch 101 is activated the gap 102 is closed and heat flux or an electrical current can flow from the input 220 to the output 221. If the thermal switch 101 shall be used as an electrical switch 101 two conditions must be fulfilled. The support structure 106 or a part of it must provide electrical insulation between the input conductor 103 and the output conductor 103. Inside the switch 101 an electrical feed-through contact from the outside to the metallic heat transfer structure inside the cavity must be provided.

An electrical switch of this design has a several advantages compared to conventional electromagnetic relays. The large cross-section area of the transfer structure and the hydraulic motion and high contact pressure gives very high current capability versus size for the switch. High voltages can also be switched on or off if the volume 107 surrounding the switch is filled with isolating fluid such as transformer oil.

Figure 7A:
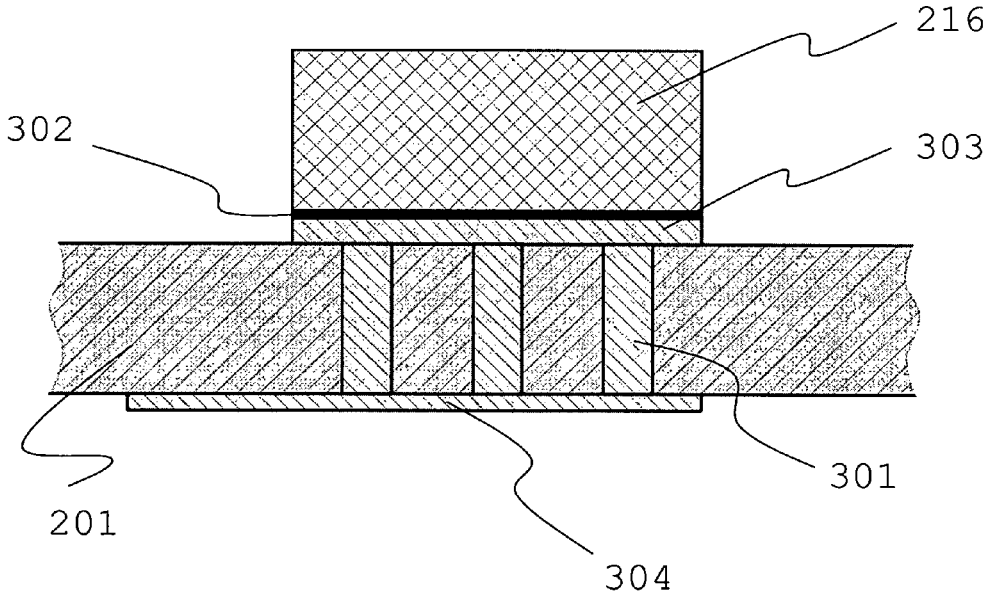
FIG. 7*a* is a cross-sectional view of a electrical high power switch with multiple through plated via holes.

For the electrical switch function a leak-tight electrical contact from the outside to the heat transfer structure is needed. It can be solved in a number of ways, whereof two possibilities are presented in FIGS. 7*a* and *b*. Multiple through plated holes 301 between an external metal layer 304 and an internal metal layer 303 are used in FIG. 7*a*. The internal layer 303 has a solder interface 302 to the heat transfer structure 216.

Figure 7B:
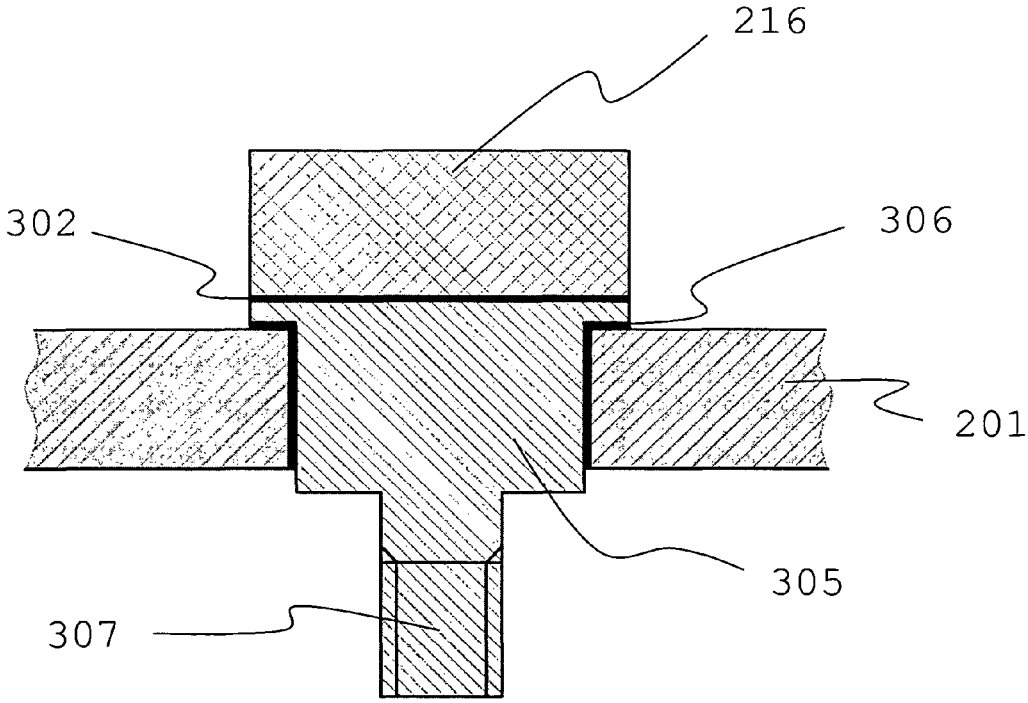
FIG. 7*b* is a cross-sectional view of an electrical high power switch with a solid metal plug with screw attachment.

FIG. 7*b* illustrates a more straightforward method of making the contact. A solid metal plug 305 is inserted in the lower wafer 201. A high temperature solder 306 is used to seal the plug 305. Moreover a low temperature solder 302 is used between the plug 305 and the heat transfer structure 216. The plug 305 can have any interface 307 to the external electrical conductor, such as screw, solder, welding, etc., and any suitable shape and surface coating to provide a good electrical contact on the surface exposed to the gap.

While the invention has been described in connection with what is presently considered to be the most practical and preferred embodiments, it is to be understood that the invention is not to be limited to the disclosed embodiments, on the contrary, is intended to cover various modifications and equivalent arrangements within the appended claims.

The invention claimed is:

1. A high conductivity switch comprising:

a sealed cavity with a first wall and a second wall, wherein at least the second wall is a membrane assembly, the second wall being adapted to be arranged with a gap to a receiving structure;

a thermal actuator material filling a portion of the sealed cavity, the thermal actuator material being adapted to change volume with temperature at least partly due to a phase change of the thermal actuator material at a predefined temperature or temperature interval; and a conductor material filling a portion of the sealed cavity, wherein the conductor material provides a high conductivity transfer structure between the first wall and the second wall, and the conductor material is in liquid phase at least at a predefined temperature or temperature interval;

whereby, in use, the thermal actuator material is arranged to upon a temperature induced volume change obtained at the predefined temperature or temperature interval, displace, the second wall, so that the gap to the receiving structure can be bridged.

2. The high conductivity switch according to claim 1, wherein the sealed cavity is formed within a stack of at least two bonded wafers.

3. The high conductivity switch according to claim 2, wherein the wafers comprise at least one of the following materials: semiconductor material, silicon, ceramic, metal, metal alloy, glass or polymer.

4. The high conductivity switch according to claim 2, wherein the wafers are shaped using one or a combination of the following technologies: etching, injection molding, electro discharge machining, rolling, laser ablation, punching.

5. The high conductivity switch according to claim 1, wherein the thermal actuator material is paraffin.

6. The high conductivity switch according to claim 1, wherein the conductor material is a metal or a metal alloy.

7. The high conductivity switch according to claim 1 further comprising a coating covering a portion of at least one of the first and second walls, wherein the conductor material has a smaller wetting angle on the coating than that of the thermal actuator material, the coating defining a confining interface between the thermal actuator material and the conductor material.

8. The high conductivity switch according to claim 1, further comprising posts protruding from at least one of the first and second walls, wherein the posts enclose the conductor material with the thermal actuator material on the outside.

9. The high conductivity switch according to claim 1, wherein the conductor material has a high thermal conductivity.

10. The high conductivity switch according to claim 1, wherein the conductor material has a high electrical conductivity.

11. The high conductivity switch according to claim 10, wherein at least one of the first and second walls has a high conductivity feed-through.

12. The high conductivity switch according to claim 1, wherein a heater element is integrated in the sealed cavity.

13. The high conductivity switch according to claim 11, wherein the gap and a volume surrounding the switch are filled with a liquid dielectric.

14. The high conductivity switch according to claim 1, wherein the thermal actuator material expands in the transition from solid to liquid due to an increase in temperature.

15. The high conductivity switch according to claim 1, wherein the thermal actuator material expands in the transition from liquid to solid due to a decrease in temperature.

16. The high conductivity switch according to claim 1, further comprising a coating covering a portion of at least one of the first and second walls, wherein the conductor material has a smaller wetting angle on the coating than that of the thermal actuator material, the coating defining the confining interface between the thermal actuator material and the conductor material.

17. The high conductivity switch according to claim 9, wherein at least one of the first and second walls has a high conductivity feed-through.

18. The high conductivity switch according to claim 10, wherein the gap and a volume surrounding the switch are filled with a liquid dielectric.

19. A high conductivity switch comprising:

a sealed cavity with a first wall and a second wall, wherein at least the second wall is a membrane assembly, the second wall being adapted to be arranged with a gap to a receiving structure;

a thermal actuator material filling a portion of the sealed cavity, the thermal actuator material being adapted to change volume with temperature; and a conductor material filling a portion of the sealed cavity, the conductor material providing a high conductivity transfer structure between the first wall and the second wall;

wherein the thermal actuator material is arranged to, upon a temperature induced volume change, displace the second wall so that the gap to the receiving structure can be bridged, and the high conductivity switch further comprises a coating covering a portion of at least one of the first and second walls, and wherein the conductor material has a smaller wetting angle on the coating than that of the thermal actuator material, the coating defining the confining interface between the thermal actuator material and the conductor material.

20. A high conductivity switch comprising:

a sealed cavity with a first wall and a second wall, wherein at least the second wall is a membrane assembly, the second wall being adapted to be arranged with a gap to a receiving structure;

a thermal actuator material filling a portion of the sealed cavity, the thermal actuator material being adapted to change volume with temperature; and a conductor material filling a portion of the sealed cavity, the conductor material providing a high conductivity transfer structure between the first wall and the second wall;

wherein the thermal actuator material is arranged to, upon a temperature induced volume change, displace the second wall so that the gap to the receiving structure can be bridged, and the high conductivity switch further comprises posts protruding from at least one of the first and second walls, and wherein the posts enclose the conductor material with the actuator material on the outside.

21. A high conductivity switch comprising:

a sealed cavity with a first wall and a second wall, wherein at least the second wall is a membrane assembly, the second wall being adapted to be arranged with a gap to a receiving structure;

a thermal actuator material filling a portion of the sealed cavity, the thermal actuator material being adapted to change volume with temperature; and a conductor material filling a portion of the sealed cavity, the conductor material providing a high conductivity transfer structure between the first wall and the second wall;

wherein the thermal actuator material is arranged to, upon a temperature induced volume change, displace the second wall so that the gap to the receiving structure can be bridged, and the high conductivity switch further comprises a coating covering a portion of at least one of the first and second walls, and wherein the conductor material has a smaller wetting angle on the coating than that of the thermal actuator material, the coating defining the confining interface between the thermal actuator material and the conductor material.

* * * * *